United States Patent [19]

Nestor

[11] Patent Number: 4,859,202

[45] Date of Patent: Aug. 22, 1989

[54] ELECTRICAL CONNECTOR HAVING STRAIN RELIEF

[75] Inventor: Charles R. Nestor, Niles, Ohio

[73] Assignee: General Motors Corporation, Detroit, Mich.

[21] Appl. No.: 187,132

[22] Filed: Apr. 28, 1988

[51] Int. Cl.[4] ..... H01R 4/24

[52] U.S. Cl. ..... 439/397; 439/407; 439/457

[58] Field of Search ..... 439/389–426, 439/456–459

[56] References Cited

U.S. PATENT DOCUMENTS

| | | | |
|---|---|---|---|
| 3,860,318 | 1/1975 | Reavis, Jr. et al. | 439/406 |
| 4,029,896 | 6/1977 | Skinner | 439/457 |
| 4,195,898 | 4/1980 | Chow et al. | 439/407 |
| 4,634,211 | 1/1987 | Poliak et al. | 439/456 |
| 4,759,723 | 7/1988 | Siemon | 439/459 |

*Primary Examiner*—Joseph H. McGlynn
*Attorney, Agent, or Firm*—Francis J. Fodale

[57] ABSTRACT

An electrical connector comprises a connector body which houses a pair of insulation displacement terminals which are attached to electrical leads which lead out of the connector body through an exit chamber. The electrical connector has a strain relief cover which includes a blade which enters the exit chamber and kinks the electrical leads laterally to pass through labyrinthian passages created by the blade so as to provide strain relief in the longitudinal direction of the electrical leads. The strain relief cover also has portions which cooperate with the connector body to provide strain relief in the lateral direction and to insure proper seating of the electrical leads in the attachment portions of the insulation displacement terminals.

6 Claims, 1 Drawing Sheet

ELECTRICAL CONNECTOR HAVING STRAIN RELIEF

BACKGROUND OF THE INVENTION

This invention relates generally to electrical connectors and more particularly to electrical connectors having terminals attached to electrical leads which lead out of a connector body.

SUMMARY OF THE INVENTION

The object of this invention is to provide an electrical connector of this type with a strain relief which firmly holds the electrical lead or leads to the terminal body.

A feature of the invention is that the strain relief kinks the electrical lead laterally to pass through a labyrinthian exit path created by the strain relief to firmly hold the electrical lead in the longitudinal direction of the electrical lead.

Another feature of the invention is that the strain relief cooperates with the connector body to firmly hold the electrical lead in the lateral direction of the electrical lead.

Still another feature of the invention is that the strain relief cooperates with the connector body to firmly hold the electrical lead in the lateral direction as well as the longitudinal direction of the electrical lead so that the strain relief is particularly well suited for use with insulation displacement terminals.

Still yet another feature of the invention is that the strain relief include means for retaining the electrical lead in insulation displacement slots of an insulation displacement terminal when the strain relief is used in conjunction with an insulation displacement terminal.

Other objects and features of the invention will become apparent to those skilled in the art as disclosure is made in the following detailed description of a preferred embodiment of the invention which sets forth the best mode of the invention contemplated by the inventor and which is illustrated in the accompanying sheet of drawing.

DETAILED DESCRIPTION OF THE PREFERRED EMBODIMENT

Figure 1:
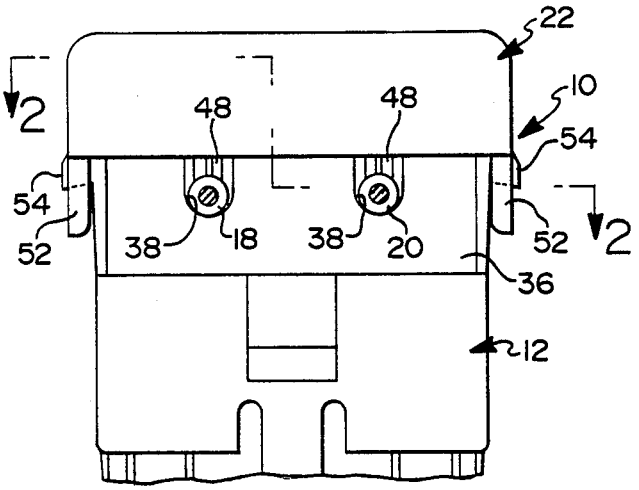
FIG. 1 is a fragmentary elevational view of an electrical connector having a strain relief in accordance with the invention.

Referring now to the drawing an electrical connector 10 in accordance with the invention comprises a connector body 12 which houses a pair of insulation displacement terminals 14 and 16 attached to electrical leads 18 and 20 and a strain relief cover 22. The electrical connector 10 is a right angle connector in which the electrical leads 18 and 20 are perpendicular, that is, at a right angle with respect to the longitudinal axis of the terminals 14 and 16. However, the invention may also be embodied in an in-line connector where the electrical leads are disposed in the same longitudinal direction as the longitudinal axis of the terminals.

Figure 2:
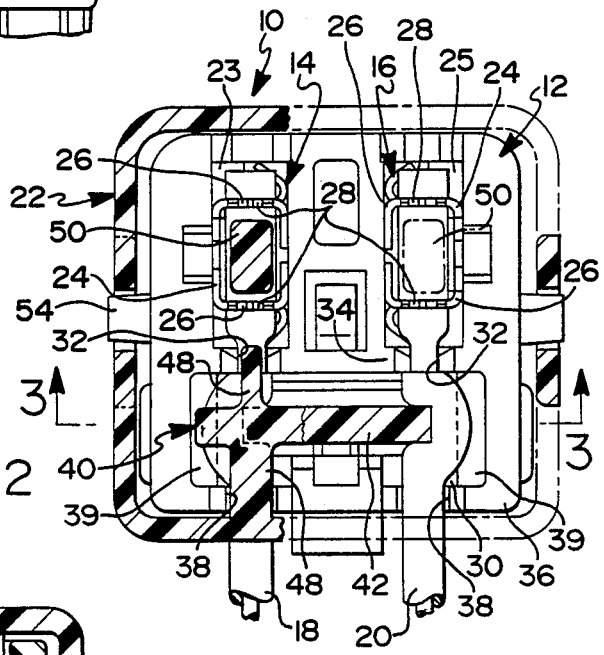
FIG. 2 is a section taken substantially along the line 2—2 of FIG. 1 looking in the direction of the arrows.

The insulation displacement terminals 14 and 16 have box-shaped attachment portions 24 which are disposed in the open end portions of the terminal cavities 23 and 25 of the connector body 12 as best seen in FIG. 2. The box-shaped attachment portions 24 of the terminals include spaced side walls 26 having insulation displacement slots 28. The electrical leads 18 and 20 are attached to the terminals 14 and 16 in a well known manner, that is, by laterally inserting the leads 18 and 20 into the insulation displacement slots 28 so that the side walls 26 cut through the insulation and engage the conductive cores of the electrical leads.

The connector body 14 has an exit chamber 30 which communicates with the terminal cavities 23 and 25 through slots 32 which extend through the wall 34 separating the exit chamber 30 from the terminal cavities 23 and 25. The opposite wall 36 of the exit chamber 30 has slots 38 which are aligned with the slots 32 which in turn are aligned with the insulation displacement slots 28 of the respective terminals 14 and 16.

The slots 32 have a lead-in but the width of the slots 32 in the separating wall 34 is preferably less than the diameter of the electrical leads 18 and 20 so that the insulation of the electrical leads is pinched and tightly gripped when the electrical leads 18 and 20 are pushed down into the slots 32. On the other hand the width of the slots 38 in the opposite exterior wall 36 are preferably slightly larger than the diameter of the electrical leads 18 and 20 so that the lead may be inserted easily. This facilitates lateral insertion of the electrical leads 18 and 20 into the insulation gripping slots 32 and the insulation displacement slots 28 of the terminals 14 and 16.

Figure 3:
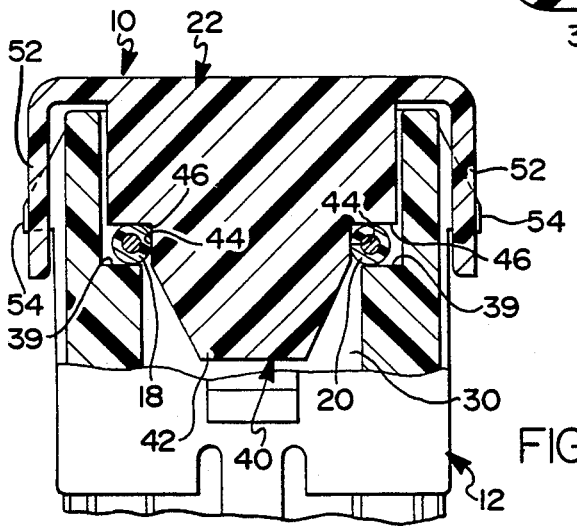
FIG. 3 is a section taken substantially along the line 3—3 of FIG. 2 looking in the direction of the arrows.

The exit chamber 30 also has shelves 39 which are near the outer sides of the slots 32 and 38 at the bottom level of the slots as shown in FIGS. 2 and 3.

The strain relief cover 22 has a depending blade 40 which projects into the exit chamber 30 when the strain relief cover 22 is attached to the connector body 12. The depending blade 40 has a tapered terminus 42 and intermediate opposite side walls 44 which partially block the respective straight line paths from the slots 32 to the slots 38 thereby creating labyrinthian passages for the electrical leads 18 and 20 when the blade 40 is inserted into the exit chamber 30. The upper end of the blade 40 is enlarged to provide abutment shoulders 46 for holding the electrical lead 18 and 20 down against the shelves 39 as shown in FIG. 3.

The strain relief cover 22 also includes depending cross members 48 which are integrally connected to the blade 40. The cross members 48 have opposite end portions which enter the slots 32 and 38 to hold the electrical leads 18 and 20 down in the connector body 12 at these locations. The strain relief cover 22 also includes depending terminal projections 50 which are aligned with the respective cross members 48 and which project into the box-shaped attachment portions 24 of the terminals 14 and 16 to hold the electric leads 18 and 20 down in the insulation displacement slots 28.

The electrical connector 10 is assembled by loading the terminals 14 and 16 into the connector body 12 and then inserting the electrical leads 18 and 20 laterally into the insulation displacement slots 28 of the respective terminals and into the slots 32 and 38 on either side of the exit chamber 30. The strain relief cover 22 is then attached. During attachment the depending blade 40 engages and kinks the electrical leads 18 and 20 laterally away from each other to pass through the labyrinthian paths which are created when the depending blade 20 is inserted into the exit chamber 30 as shown in FIG. 2.

When the strain relief cover 22 is attached, the shoulders 46 of the depending blade 40 engage the laterally kinked portions of the electrical leads 18 and 20 and hold them against the shelves 39 in the exit chamber 30 as shown in FIG. 3. The cross members 48 and projections 50 also engage the electrical leads 18 and 20 to insure that the electrical leads are firmly held in the lateral direction and properly seated in the insulation displacement slots 28 of the terminals 14 and 16 and in the slots 32 and 38 of the connector body 12. The strain relief cover is retained by conventional latch arms 52 which engage lock nibs 54 of the connector body 12.

I wish it to be understood that I do not desire to be limited to the exact details of construction shown and described, for obvious modifications will occur to a person skilled in the art.

The embodiments of the invention in which an exclusive property or privilege is claimed are defined as follows:

1. An electrical connector comprising:

a connector body which houses an insulation displacement terminal attached to an electrical lead and a strain relief cover, said connector body having a terminal cavity which houses the insulation displacement terminal and an exit chamber which communicates with the terminal cavity through a slot which extends through a separating wall of the connector body which separates the exit chamber from the terminal cavity, said exit chamber having a second wall opposite the separating wall which has a slot which is aligned with the slot of the separating wall, said electrical lead passing through the slot of the separating wall, the exit chamber and the slot of the second wall, one of the slots having a width which is less than the diameter of the electrical lead so that the insulation of the electrical lead is pinched and tightly gripped when the electrical lead is pushed down into the one slot, said strain relief cover having a depending blade which projects into the exit chamber when the strain relief cover is attached to the connector body, said depending blade having a side wall which partially blocks a straight line path from the slot in the separating wall to the slot in the opposite wall thereby creating a labyrinthian passage for the electrical lead when the blade is inserted into the exit chamber, said side wall engaging and kinking the electrical lead laterally to pass through the labyrinthian path which is created when the depending blade is inserted into the exit chamber, and means for retaining the strain relief cover on the connector body.

2. The electrical connector as defined in claim 1 wherein:

said exit chamber includes a shelf which is between the separating wall and the opposite wall near one side of the slots at the bottom level of the slots, and said depending blade has an abutment shoulder which engages the laterally kinked portion of the electrical lead and holds it against the shelf in the exit chamber.

3. The electrical connector as defined in claim 1 wherein:

said strain relief cover includes a depending cross member which is integrally connected to the blade and which has opposite end portions which enter the slots of the separating and opposite walls to hold the electrical lead firmly in the lateral direction.

4. The electrical connector as defined in claim 3 wherein:

said exit chamber includes a shelf which is between the separating wall and the opposite wall near one side of the slots at the bottom level of the slots, and said depending blade has an abutment shoulder which engages the laterally kinked portion of the electrical lead and holds it against the shelf of the exit chamber.

5. An electrical connector comprising:

a connector body which houses a pair of insulation displacement terminals attached to respective electrical leads and a strain relief cover, said connector body having an exit chamber which communicates with the terminal cavities through slots which extend through a separating wall of the connector body which separates the exit chamber from the terminal cavities, said exit chamber having a second wall opposite the separating wall which has slots which are aligned with the slots of the separating wall which in turn are aligned with the insulation displacement slots of the respective terminals, said electrical leads passing through the slots of the separating wall, the exit chamber and the slots of the second wall, said exit chamber further including shelves which extend from the separating wall to the opposite wall near the outer sides of the slots at the bottom level, of the slots, said strain relief cover having a depending blade which projects into the exit chamber when the strain relief cover is attached to the connector body, said depending blade having a tapered terminus and intermediate opposite walls which partially block the respective straight line paths from the slots to the slots thereby creating labyrinthian passages for the electrical leads when the blade is inserted into the exit chamber, said side walls engaging and kinking the electrical leads laterally away from each other to pass through the labyrinthian paths which are created when the depending blade is inserted into the exit chamber, said depending blade having an enlarged upper end which provide abutment shoulders which engage the laterally kinked portions of the electrical leads and hold them against the shelves in the exit chamber, said strain relief cover further including depending cross members which are integrally connected to the blade and which have opposite end portions which enter the slots of the separating and opposite walls to hold the electrical leads firmly in the lateral direction, and means for retaining the strain relief cover on the connector body.

6. The electrical connector as defined in claim 5 wherein:

the slots in the separating wall have a width which is less than the diameter of the electrical leads so that the insulation of the electrical leads is pinched and tightly gripped when the electrical leads are pushed down into the slots, and the slots in the second opposite wall have a width which is larger than the diameter of the electrical leads so that the leads may be laterally inserted easily.

* * * * *